United States Patent [19]

Massó Remiro

[11] 4,117,837

[45] Oct. 3, 1978

[54] MONOPIECE FACE MASK FOR BEAUTY TREATMENT

[75] Inventor: Jose Maria Massó Remiro, Barcelona, Spain

[73] Assignee: Turbo, S.A., Barcelona, Spain

[21] Appl. No.: 795,184

[22] Filed: May 9, 1977

[30] Foreign Application Priority Data

May 26, 1976 [ES] Spain ..... 221.224[U]

[51] Int. Cl.[2] ..... A61F 5/08

[52] U.S. Cl. ..... 128/76 B; 128/163

[58] Field of Search ..... 128/76 R, 76 B, 163, 128/68.1, 164, 97; 2/174

[56] References Cited

U.S. PATENT DOCUMENTS

| | | | |
|---|---|---|---|
| 1,023,677 | 4/1912 | Pass | 2/174 |
| 1,655,440 | 1/1928 | Soble | 128/163 |
| 1,693,452 | 11/1928 | McCune | 128/164 |
| 1,810,486 | 6/1931 | Lancaster | 128/163 |
| 1,862,588 | 6/1932 | Conley | 128/163 |
| 2,002,449 | 5/1935 | Dohm | 128/163 |
| 2,558,263 | 6/1951 | Merrill | 128/163 |
| 2,728,339 | 12/1955 | Elmhirst | 128/76 R |

FOREIGN PATENT DOCUMENTS

| | | | |
|---|---|---|---|
| 390,796 | 8/1908 | France | 128/164 |
| 854,830 | 11/1952 | Fed. Rep. of Germany | 128/163 |
| 28,515 of | 1913 | United Kingdom | 128/163 |

*Primary Examiner*—Lawrence W. Trapp

*Attorney, Agent, or Firm*—Wenderoth, Lind & Ponack

[57] ABSTRACT

A monopiece face mask for beauty treatment includes a sheet which is stretchable in all directions and is impermeable, which is shaped according to the head of a human being and which covers the head up to the neck with the exception of the cranial cavity. The sheet is provided with two openings for the ears and has a series of markings defining zones which can be cut out so that the elastic action of the mask is directed to specific regions of the skin.

1 Claim, 3 Drawing Figures

MONOPIECE FACE MASK FOR BEAUTY TREATMENT

The present invention refers to a monopiece face mask for beauty treatment.

To maintain the face smooth, masks which are fixed to the face by fastening, exerting an elastic pressure thereon, are presently being used.

These masks are uncomfortable at their fastening zone, irrespective of the means used.

On the other hand, the action of the mask is directed to smoothen the cheeks, discarding those zones of the face which are, aesthetically, as important or more important than the cheeks, such as for example, the forehead, corner of the mouth, eyebrows, chin and double chin.

In short, since each face is a particular case, the mask of the present invention has been designed.

Generally speaking, the present invention refers to a face mask made from an anatomically molded monopiece sheet which incorporates a series of marked zones which can be cut out forming openings, so that the action of the remainder of the mask is directed to exclusively treat those parts of the head in need of treatment. The user, in view of the marked zones and the specific instructions, can adapt the mask to her specific case, enlarging or reducing the area subjected to treatment.

The beneficial action of the mask specifically resides in the prior molding thereof, since those existing in the market are made from a flat sheet. Besides, the mask of the present invention discards fastening means and contributes the ability of adapting same to each particular case.

To complement the description which will subsequently be made and for a better understanding of the characteristics of the invention, a set of drawings is attached hereto wherein the following is represented:

Figure 1:
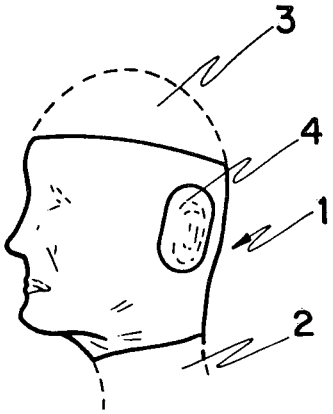
FIG. 1 illustrates a side elevational view of a face mask arranged on a human head.
Figure 2:
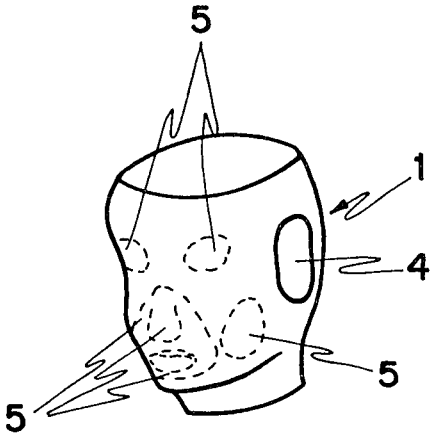
FIG. 2 illustrates a perspective view of the mask, object of the present invention.
Figure 3:
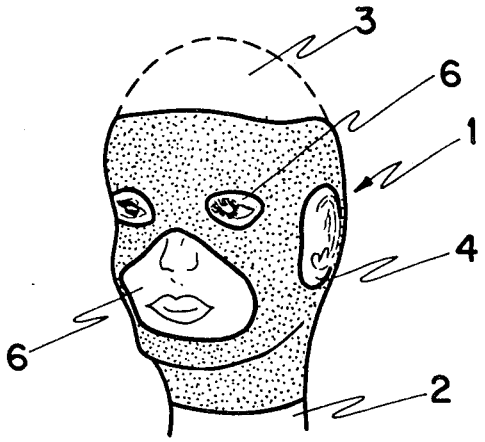

Finally, FIG. 3 corresponds to a perspective view of the mask, object of the present invention, on a human head.

Mask 1 comprises a sheet, stretchable in all directions and impermeable, which is shaped according to the head of a human being, which sheet covers the head up to the neck 2 with the exception of the cranial cavity 3.

Mask 1 is provided with two openings 4 for the ears.

Mask 1 is provided, superficially, with a plurality of markings 5 defining zones which can be cut out to form the mentioned openings, so that the elastic action of the mask is directed to those zones of the skin in need of treatment, with the exception of the cranial cavity 3.

In this way and in view of these openings 6, the user can adapt the mask 1 to her specific case, since she eliminates the action thereof on those zones which are not in need of treatment.

I claim:

1. Monopiece face mask for beauty treatment, essentially characterized in that it comprises a sheet, stretchable in all directions and impermeable, which is shaped according to the head of a human being and which covers said head up to the neck with the exception of the cranial cavity, said sheet being provided with two openings for the ears and having superficially a series of markings defining zones which can be cut out so that the elastic action of the mask is directed to specific regions of the skin.

* * * * *